US011987327B2

(12) United States Patent
Corbineau

(10) Patent No.: US 11,987,327 B2
(45) Date of Patent: May 21, 2024

(54) METHOD AND DEVICE FOR DETERMINING SLOSHING

(71) Applicant: GAZTRANSPORT ET TECHNIGAZ, Saint Remy les Chevreuse (FR)

(72) Inventor: Erwan Corbineau, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 382 days.

(21) Appl. No.: 17/607,321

(22) PCT Filed: May 7, 2020

(86) PCT No.: PCT/EP2020/062678
§ 371 (c)(1),
(2) Date: Oct. 28, 2021

(87) PCT Pub. No.: WO2020/225353
PCT Pub. Date: Nov. 12, 2020

(65) Prior Publication Data

US 2022/0204141 A1 Jun. 30, 2022

(30) Foreign Application Priority Data

May 9, 2019 (FR) ..... FR1904837

(51) Int. Cl.
*B63B 25/24* (2006.01)
*B63B 79/20* (2020.01)

(52) U.S. Cl.
CPC ..... *B63B 25/24* (2013.01); *B63B 79/20* (2020.01)

(58) Field of Classification Search
CPC ..... B63B 25/24; B63B 79/20
See application file for complete search history.

(56) References Cited

U.S. PATENT DOCUMENTS 8,643,509 B1 2/2014 Chen
8,770,125 B2 * 7/2014 Guerrier ..... B63B 39/005 114/74 R
2017/0369127 A1 12/2017 Cusano et al.

FOREIGN PATENT DOCUMENTS

CN 106529087 A 3/2017
FR 2691520 A1 11/1993
(Continued)

OTHER PUBLICATIONS

International Search Report for corresponding PCT application No. PCT/EP2020/062678, dated Jul. 2, 2020.
(Continued)

*Primary Examiner* — Anthony D Wiest
(74) *Attorney, Agent, or Firm* — Notaro, Michalos & Zaccaria P.C.

(57) ABSTRACT

The invention relates to a method (200) for determining the sloshing of a liquid loading of a vessel, said method (200) comprising:

a step (206) of determination of a monomodal excitation as a function of a multimodal excitation to which said vessel is subjected, the multimodal excitation comprising a state of the swell and a wind sea state, wherein the state of the swell comprises a direction of the swell and the wind sea state comprises a wind sea direction, and wherein the monomodal excitation exhibits a total direction equivalent to one out of the direction of the swell and the wind sea direction closest to a direction at right angles to the longitudinal axis of the vessel, a step (208) of determination of a datum relating to the sloshing of said loading as a function of the monomodal excitation.

11 Claims, 2 Drawing Sheets

(56) References Cited

FOREIGN PATENT DOCUMENTS

| | | | |
|---|---|---|---|
| FR | 2877638 | A1 | 5/2006 |
| WO | 2010059307 | A1 | 5/2010 |
| WO | 2014057221 | A2 | 4/2014 |

OTHER PUBLICATIONS

Search Report from Intellectual Property Office of Singapore for corresponding Singapore Application No. 11202112068U.

* cited by examiner

METHOD AND DEVICE FOR DETERMINING SLOSHING

TECHNICAL FIELD

The present invention relates to the field of the methods and devices for determining sloshing, in particular for determining the sloshing of liquid loading in vessels.

TECHNOLOGICAL BACKGROUND

During its storage and/or transportation, the liquid contained in a tank is subjected to different movements. In particular, the movements at sea of a vessel including the tank, for example under the effect of the weather conditions such as the state of the sea or the wind, cause an agitation of the liquid in the tank. The agitation of the liquid, generally referred to as "sloshing", generates stresses on the walls of the tank which can damage the integrity of the tank. Now, the integrity of the tank is particularly important in the context of a tank of LNG, through the flammable or explosive nature of the liquid being transported and the risk of a cold point on the steel hull of the floating unit.

A method is known, described by U.S. Pat. No. 8,643,509, for determining a risk of damage to the tank generated by the sloshing of the liquid and alerting a driver of the vessel when the risk of damage exceeds a predetermined threshold. The method determines the risk of damage generated by the sloshing as a function of the sea states to which the vessel is subjected, which are determined from weather and oceanic conditions, and from a digital model of the vessel.

SUMMARY

The present inventors have found that a precise accounting of the sea states is complex to implement in a digital model, given the large number of possible sea states, notably the existence of multimodal sea conditions in certain circumstances.

One idea on which the invention is based is to determine the sloshing of the liquid contained in the vessel by a method that is relatively economical in terms of computation time and computation resources. For that, another idea on which this invention is based is to provide a method for determining the sloshing by the determination of a sea state that is less complex to reduce the computation time without reducing the reliability of determination of the sloshing.

According to one embodiment, the invention provides a method for determining the sloshing of a liquid loading of a vessel, said method comprising:

- a step of determination of a monomodal excitation as a function of a state of the swell and of a wind sea state to which said vessel is subjected,
- a step of determination of a datum relating to the sloshing of said loading as a function of the monomodal excitation.

The method is advantageous in that it determines a monomodal excitation equivalent to a multimodal excitation comprising the state of the swell and the wind sea state. The sloshing is thus determined for an equivalent monomodal excitation and not from the multimodal excitation, which would be much more complex to model by computation or by experimentation. The method is thus less intensive in terms of computing resources and requires less computation time compared to the state of the art.

According to embodiments, such a method can comprise one or more of the following features.

The step of determination of the sloshing can be performed in different ways. According to one embodiment, the datum relating to the sloshing is determined as a function of the monomodal excitation by consultation of a previously established database comprising data representing the sloshing as a function of the monomodal excitation. The database can comprise sloshing levels obtained by experimentation in a laboratory or from onboard measurement campaigns at sea as a function of the monomodal excitation. According to another embodiment, the datum relating to the sloshing is determined by a previously established digital modeling expressing the sloshing as a function of the monomodal excitation.

The state of the swell and/or the wind sea state define environmental data of the vessel. According to one embodiment, the state of the swell comprises a significant height of the swell and/or a peak period of the swell and/or a direction of the swell with respect to a longitudinal axis of the vessel. According to one embodiment, the wind sea state comprises a significant wind sea height and/or a peak wind sea period and/or a wind sea direction with respect to a longitudinal axis.

According to one embodiment, the state of the swell and/or the wind sea state are determined in real time by sensors provided in the vessel and configured to measure a significant height of the swell and/or a peak period of the swell and/or a direction of the swell and a significant wind sea height and/or a peak wind sea period and/or a wind sea direction.

According to one embodiment, the state of the swell and/or the wind sea state are determined indirectly from meteorological and oceanic conditions.

According to one embodiment, the state of the swell and/or the wind sea state are determined by weather prediction.

The monomodal excitation can be determined in different ways. According to one embodiment, the state of the swell comprises a significant height of the swell and the wind sea state comprises a significant wind sea height, and the monomodal excitation exhibits a total significant height equal to a root mean square of said significant height of the swell and of said significant wind sea height.

According to one embodiment, the state of the swell comprises a peak period of the swell and the wind sea state comprises a peak wind sea period, and the monomodal excitation exhibits a total peak period equal to one out of the peak period of the swell and the peak wind sea period selected as the period generating the most severe sloshing of the loading. In this case, the method can comprise a step for selecting the total peak period out of the peak period of the swell and the peak wind sea period by:

- a first database consultation, for example data acquired by experimentation, to determine a first sloshing generated by the peak period of the swell,
- a second database consultation to determine a second sloshing generated by the peak wind sea period, and
- a determination of the most severe sloshing out of the first sloshing and the second sloshing.

According to one embodiment, the state of the swell comprises a direction of the swell and the wind sea state comprises a wind sea direction, and the monomodal excitation exhibits a total direction equivalent to one out of the direction of the swell and the wind sea direction closest to a direction at right angles to the longitudinal axis of the vessel.

According to one embodiment, the method comprises a step of determination of a probability of damage to a tank of the vessel comprising all or part of the loading as a function of the datum relating to the sloshing and of a level of filling of said tank. In particular, the probability of damage is relative to a density of probability of encountering a pressure on an internal surface of the tank greater than an internal resistance of the tank as a function of the datum relating to the sloshing and the level of filling of the tank.

In particular, the level of filling of the tank can be determined by filling level sensors arranged in said tank.

According to one embodiment, the method comprises a step of emission of an audio or visual signal for an operator of the vessel when the datum relating to the sloshing is above a predetermined threshold.

According to one embodiment, the method further comprises a step consisting in detecting that the vessel is subject to a significantly multimodal excitation. In this case, a significantly multimodal excitation is detected when:

the significant height of the swell and the significant wind sea height are non-zero, and a difference between the direction of the swell and the wind sea direction is greater than 15°, and the significant height of the swell and the significant wind sea height are less than 85% of a root mean square of the significant height of the swell and of the significant wind sea height.

According to this embodiment, the method comprises, following the detection that the vessel is subject to a significantly multimodal excitation, a step of determination of a datum relating to the sloshing as a function of the wind sea state and the state of the swell of the significantly multimodal excitation. The method can further comprise, in response to the detection that the vessel is not subject to a significantly multimodal excitation, a step of determination of the datum relating to the sloshing of the loading as a function of a recombined monomodal excitation corresponding to the state of the swell and the wind sea state. In this case, the recombined monomodal excitation is provided by meteorological or oceanic services.

According to one embodiment, the liquid is a liquefied gas, for example liquefied natural gas.

According to another aspect of the invention, a device is proposed for determining the sloshing of a liquid loading of a vessel, said device comprising a processor configured to implement the abovementioned method.

Such a device or method for determining sloshing can be installed in a floating, coastal or deep water structure, notably a methane tanker vessel, a floating storage and regasification unit (FSRU), a floating production and storage offshore (FPSO) unit, a barge and the like. Furthermore, such a device or method for determining sloshing can be implemented for the dimensioning of the floating structure, in particular the dimensioning of a tank of a vessel or of said vessel as a function of the datum relating to the sloshing of the loading determined by such a device or such a method. Such a device or method for determining sloshing can also be implemented to determine navigation setpoints, for example a speed of the vessel, a direction, to be executed automatically or by a driver of the vessel, in order to reduce or avoid a level of sloshing of the vessel.

According to another aspect of the invention, a vessel is proposed, for example for transporting a cold liquid product such as liquefied natural gas, comprising at least one tank comprising a loading and the abovementioned device for determining sloshing.

BRIEF DESCRIPTION OF THE FIGURES

The invention will be better understood, and other aims, details, features and advantages thereof will become more clearly apparent, from the following description of several particular embodiments of the invention, given purely in an illustrative and nonlimiting manner, with reference to the attached drawings.

DESCRIPTION OF THE EMBODIMENTS

The figures are described hereinbelow in the context of a vessel 1 comprising a double-hull forming a bearing structure in which there are arranged a plurality of sealed and thermally insulating tanks. Such a bearing structure has, for example, a polyhedral geometry, for example of prismatic form.

Such sealed and thermally insulating tanks are provided, for example, for the transportation of liquefied gas. The liquefied gas is stored and transported in such tanks at a low temperature which necessitates thermally insulating tank walls in order to keep the liquefied gas at that temperature. It is therefore particularly important to keep intact the integrity of the tank walls, on the one hand to conserve the sealing of the tank and avoid leaks of liquefied gas out of the tanks and, on the other hand, to avoid degradations of the insulating characteristics of the tank in order to keep the gas in its liquefied form.

Such sealed and thermally insulating tanks also comprise an insulating barrier anchored on the double-hull of the vessel and bearing at least one sealed membrane. As an example, such tanks can be produced according to the technologies of Mark III® type, as described for example in FR2691520, of NO96® type as described for example in FR2877638, or otherwise as described for example in WO14057221.

Figure 1:
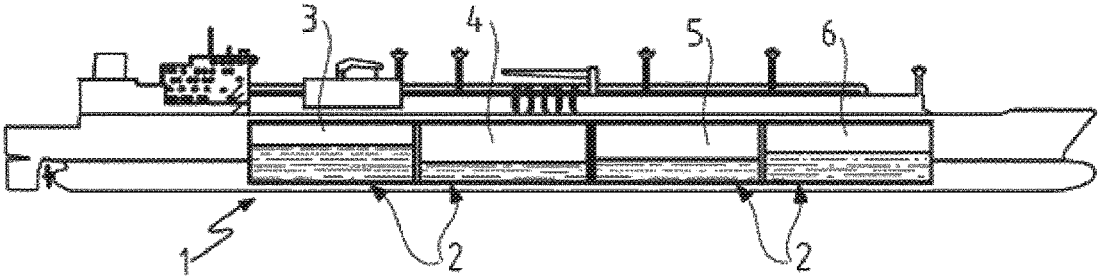
FIG. 1 is a schematic representation in longitudinal cross-section of a vessel comprising a plurality of tanks containing a liquid loading.

FIG. 1 illustrates a vessel 1 comprising four sealed and thermally insulating tanks 2. On such a vessel 1, the tanks 2 are connected to one another by a cargo handling system (not illustrated) that can include many components, for example pumps, valves and ducts so as to allow liquid to be transferred from one of the tanks 2 to another tank 2.

The four tanks 2 in FIG. 1 have an initial state of filling. In this initial state, the tanks are partially filled. A first tank 3 is filled to approximately 60% of its capacity. A second tank 4 is filled to approximately 35% of its capacity. A third tank 5 is filled to approximately 35% of its capacity. A fourth tank 6 is filled to approximately 40% of its capacity.

This partial filling of the tanks 3, 4, 5, 6 may generate significant risks of damage to said tanks 3, 4, 5, 6 when the vessel 1 navigates at sea. Indeed, when it is at sea, the vessel 1 is subject to numerous movements linked to the navigation conditions.

Figure 2:
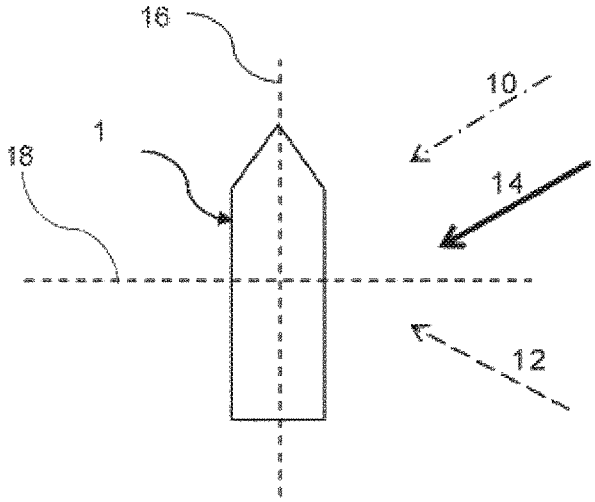
FIG. 2 is a schematic representation of a wind sea state and of a state of swell to which the vessel of FIG. 1 can be subjected.

In particular, the vessel 1 is subject, on the one hand, to a first excitation, the wind sea excitation represented by the axis 10, and to a second excitation, the excitation of the swell represented by the axis 12 in FIG. 2. The wind sea induces waves that have a wind sea direction parallel to the axis 10 with respect to a longitudinal axis 16 of the vessel 1, a significant wind sea height and a peak wind sea period. Similarly, the swell provokes waves that have a swell direction parallel to the axis 12 with respect to the longitudinal axis 16, a significant height of the swell and a peak period of the swell. The meeting of the waves induced by the swell and the wind sea generates a multimodal excitation of the vessel 1 provoking the movements of the vessel 1. These movements of the vessel 1 affect the liquid contained in the tanks 3, 4, 5, 6 which, consequently, is subject to sloshing in the tanks 3, 4, 5, 6 producing impacts on the tank walls. When the sloshing exceeds the capacity of the tank walls to absorb or disperse the sloshing, the impacts on the walls of the tanks 3, 4, 5, 6 can degrade the walls of the tanks 3, 4, 5, 6. Now, it is important to maintain the integrity of the walls of the tanks 3, 4, 5, 6 to maintain the sealing and the insulation characteristics of the tanks 3, 4, 5, 6. It is therefore important to determine the sloshing in order to avoid such degradations.

Figure 3:
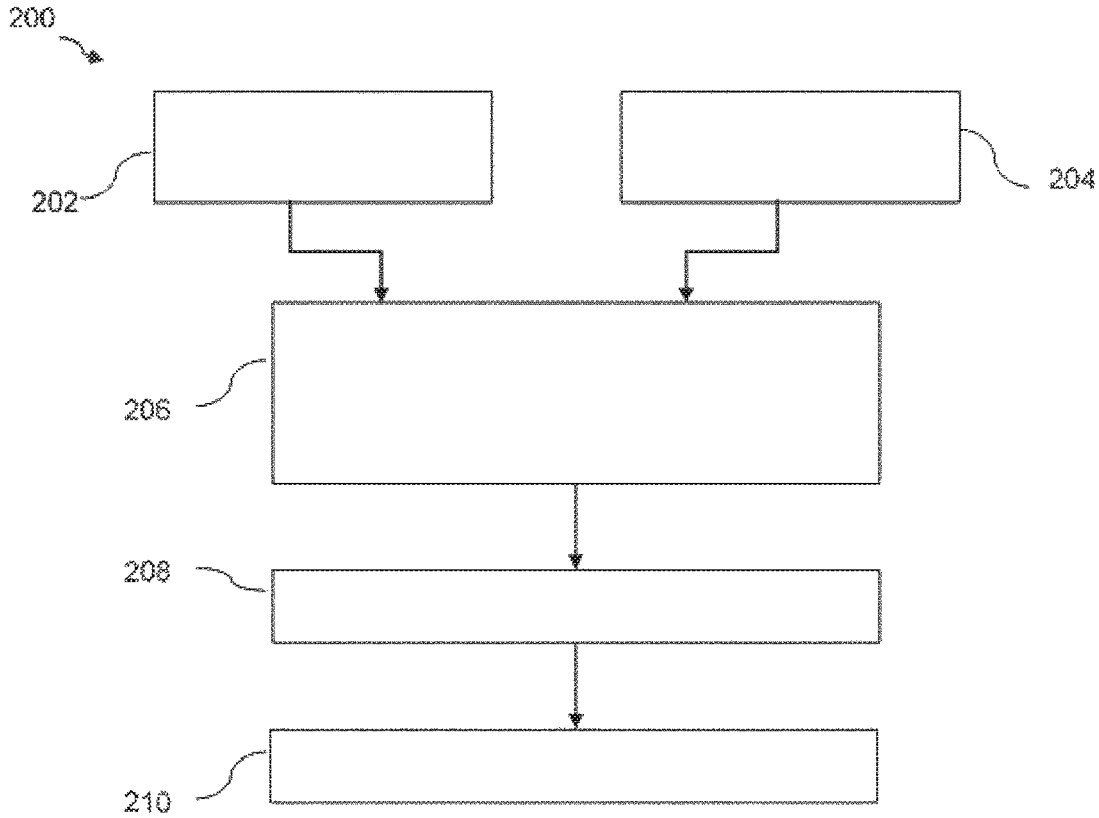
FIG. 3 is a schematic representation of a method for determining the sloshing of the vessel of FIG. 1.

For that, a method 200, represented in FIG. 3, for determining sloshing can be implemented by the vessel 1 to estimate a monomodal excitation represented by the axis 14 in FIG. 2 that is equivalent to the total excitation of the vessel 1 provoked by the meeting of the wind sea excitation 10 and the excitation 12 of the swell.

The method 200 comprises the following steps:

- step 202: acquisition of a wind sea state comprising the significant wind sea height $Hs_{windsea}$, the peak wind sea period $Tp_{windsea}$ and the wind sea direction $Hg_{windsea}$ with respect to the longitudinal axis 16,
- step 204: acquisition of a state of the swell comprising the significant height of the swell $Hs_{swell}$, the peak period of the swell $Tp_{swell}$ and the direction of the swell $Hg_{swell}$ with respect to the longitudinal axis 16,
- step 206: determination of the monomodal excitation by determination of a total height $Hs_{tot}$, the total peak period $Tp_{tot}$ and the total direction $Hg_{tot}$ as a function of the wind sea state and of the state of the swell,
- step 208: determination of a datum relating to the sloshing of the liquid contained in the vessel 1 as a function of the monomodal excitation determined in the step 206.

According to one embodiment, the steps 202 and 204 are performed by acquisition of measurements relating to the wind sea state and to the state of the swell by sensors deployed in the vessel 1. Alternatively, the steps 202 and 204 are performed by acquisition of predictions of the state of the swell and the wind sea state previously determined.

According to one embodiment, the total height $Hs_{tot}$ is determined in the step 206 by solving the following equation:

$$Hs_{tot}=\sqrt{Hs_{\text{windsea}}^{2}+Hs_{\text{swell}}^{2}} \quad \text{[Math. 1]}$$

According to one embodiment, the total peak period $Tp_{tot}$ is determined in the step 206 by determination of the peak period out of those of the swell $Tp_{swell}$ and of the wind sea $Tp_{windsea}$ generating the most severe sloshing of the loading in monomodal excitation, for example by consulting a database or by digital computation.

According to one embodiment, the total direction $Hg_{tot}$ is determined in the step 206 by determination of the direction out of the direction of the swell $Hg_{swell}$ and the wind sea direction $Hg_{windsea}$ closest to a direction at right angles 18 to the longitudinal axis 16 of the vessel 1. In a case where these two directions are symmetrical with respect to the right-angled direction 18, the excitation which comes from the front of the vessel is retained.

The step 208 can be performed by consulting a database previously established for the vessel 1 or by digital computation based on a previously established numerical modeling expressing the sloshing as a function of the monomodal excitation 14.

According to one embodiment, the method 200 comprises a step 210 of determination of a risk of damage $Risk_{ope}$ of a tank 2 as a function of the datum relating to the sloshing determined in the step 208 and the level of filling of said tank 2. In particular, the risk of damage $Risk_{ope}$ is determined by the following equation:

$$Risk_{ope}=\int_{0}^{surf}\int_{0}^{t_{ope}} prob_{tk}(Pres_{surf}>Res_{surf},SC(fl))\cdot dt\cdot dsurf \quad \text{[Math. 2]}$$

with SC being a level of sloshing generated by the datum relating to the sloshing for the level of filling fl of the tank, $prob_{tk}$ represents the density of probability of encountering a pressure $Pres_{surf}$ on an internal surface of the tank greater than the resistance $Res_{surf}$ of said internal surface of the tank as a function of the level of sloshing SC(fl), surf is the internal surface of the tank impacted by the liquid, and $t_{ope}$ is the time of navigation operation of the vessel 1 subjected to the wind sea state and the swell generating the level of sloshing SC(fl) for the level of filling fl.

The law $prob_{tk}$ is a statistical law, for example of GEV, Weibull, Pareto or Gumbel type. One, several or all of the parameters of this law are for example defined from monomodal tests of liquid movement in a laboratory or from monomodal measurement campaigns at sea.

Figure 4:
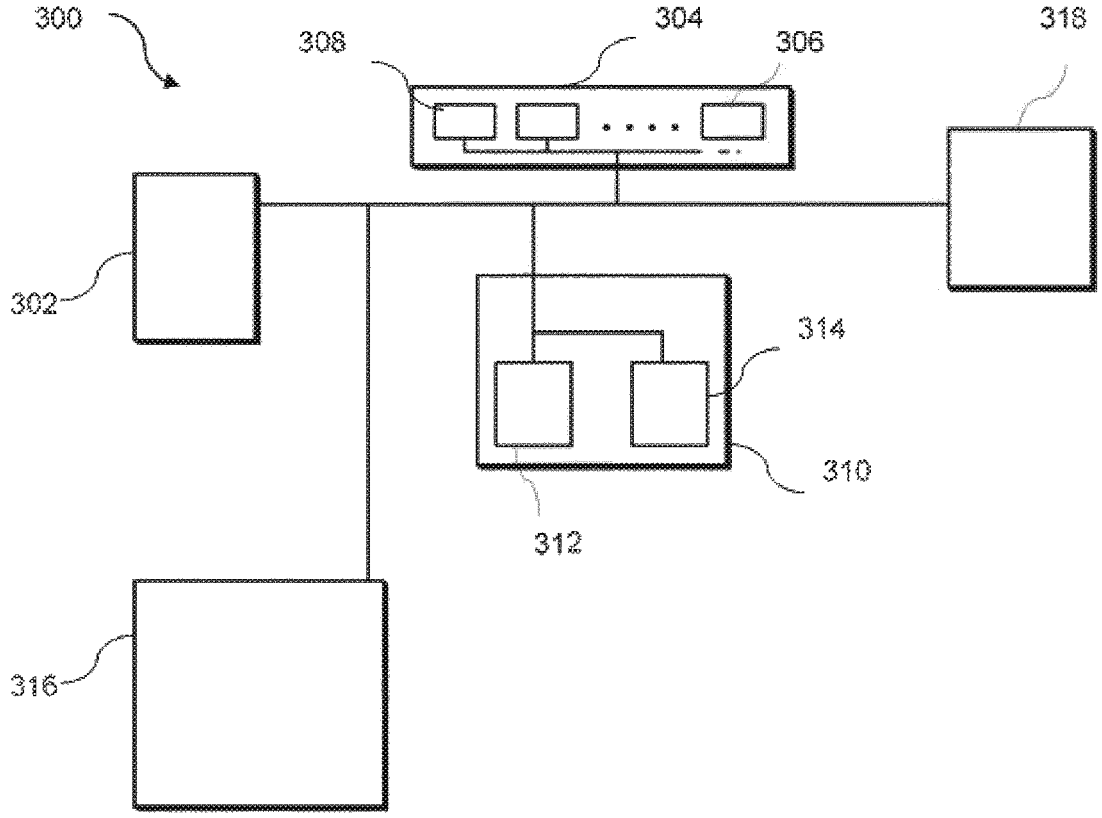
FIG. 4 is a schematic representation of a device for determining the sloshing of the vessel of FIG. 1.

FIG. 4 illustrates a device 300 for determining the sloshing that can be installed on the vessel 1. This device 300 comprises a central unit 302 configured to perform the various steps of the method 200 to determine the datum relating to the sloshing of the vessel and/or the risk of damage to a tank 2 of the vessel 1.

The central unit 302 is connected to a plurality of embedded sensors 304 that make it possible to obtain the various quantities indicated above. Thus, the sensors 304 comprise, for example and non-exhaustively, a sensor 306 of the filling level of each tank, different sensors 308 (accelerometer, strain gauge, deformation gauge, sound, light) allowing the central unit 302, via a dedicated algorithm, to detect the impacts linked to the movements of the liquid in the tanks 3, 4, 5, 6, etc.

The device 300 further comprises a human-machine interface 310. This human-machine interface 310 comprises a display means 312 allowing an operator of the vessel 1 to obtain the various information, for example information on the datum relating to the sloshing determined by implementing the steps of the method 200, the risk of damage to one of the tanks 2 of the vessel 1, the quantities obtained by the sensors 308 such as the intensity of the liquid movements in the tanks, information on the impacts linked to these liquid movements, the movements of the vessel, the state of loading of the vessel or even meteorological information.

The human-machine interface 310 further comprises an acquisition means 314 allowing the operator to manually supply quantities to the central unit 302, typically to supply the central unit 302 with data that cannot be obtained by sensors because the vessel does not include the necessary sensor or the latter is damaged. For example, in one embodiment, the acquisition means allows the operator to input information on the wind sea state and/or the state of the swell.

The device 300 comprises a database 316. This database 316 comprises, for example, certain quantities obtained in the laboratory or from onboard measurement campaigns at sea. For example, the database 316 can comprise data relating to the sloshing as a function of the monomodal excitation. In particular, the database can store data representative of the overall or local stresses exerted on the tank wall, for each value of amplitude, of frequency and of incidence of the monomodal excitation. These data representative of the stresses exerted on the tank wall can for example be a distribution of the pressure exerted on the tank wall, namely the function $P_{surf}$.

In one embodiment, the calculations of the risk of damage are also pre-established and the database can directly store data representative of the risk of damage $Risk_{ope}$ for each significant height, peak period and direction value of the monomodal excitation.

The device 300 also comprises a communication interface 318 allowing the central unit 302 to communicate with remote devices, for example to obtain meteorological data, vessel position data or other data.

According to one embodiment, the central unit 302 is configured to determine a navigation datum, for example a heading of the vessel, a speed, etc., as a function of the datum relating to the sloshing and/or to the risk of damage.

Certain elements represented, notably the central unit 302, can be produced in various forms, individually or distributed, by means of hardware and/or software components. Hardware components that can be used are custom integrated circuits ASIC, programmable logic arrays FPGA or microprocessors. Software components can be written in different programming languages, for example C, C++, Java or VHDL. This list is not exhaustive.

Although the invention has been described in association with several particular embodiments, it is clearly obvious that it is no way limited thereto and that it encompasses all the technical equivalents of the means described as well as the combinations thereof provided the latter fall within the scope of the invention.

The use of the verb "comprise" or "include" and its conjugate forms does not exclude the presence of elements or steps other than those stated in a claim.

In the claims, any reference symbol between parentheses should not be interpreted as a limitation on the claim.

The invention claimed is:

1. A method (200) for determining the sloshing of a liquid loading of a vessel (1), said method (200) comprising:

a step (206) of determination of a monomodal excitation as a function of a multimode excitation to which said vessel is subjected, the multimodal excitation comprising a state of the swell and a wind sea state, wherein the state of the swell comprises a direction of the swell and the wind sea state comprises a wind sea direction, and wherein the monomodal excitation exhibits a total direction equivalent to one out of the direction of the swell and the wind sea direction closest to a direction at right angles to the longitudinal axis of the vessel, a step (208) of determination of a datum relating to the sloshing of said loading as a function of the monomodal excitation, wherein the data relating to the sloshing is determined as a function of the monomodal excitation through consultation of a previously established database, said database comprising data relating to the sloshing expressing the sloshing as a function of the monomodal excitation, wherein the data relating to the sloshing are determined by experimental measurements, and a step (210) of determination of a probability of damage to a tank (2) of the vessel (1) comprising all or a part of the loading as a function of the data relating to the sloshing and of a level of filing of said tank, wherein the probability of damage is relative to a density of probability of encountering a pressure on an internal surface of the tank greater than an internal resistance of the tank as a function of the datum relating to the sloshing and of the level of filling of the tank.

2. The method (200) as claimed in claim 1, wherein the state of the swell comprises a significant height of the swell and/or a peak period of the swell and/or a direction of the swell with respect to a longitudinal axis of the vessel.

3. The method (200) as claimed in claim 1, wherein the wind sea state comprises a significant wind sea height and/or a peak wind sea period and/or a wind sea direction with respect to a longitudinal axis.

4. The method (200) as claimed in claim 1, wherein the state of the swell comprises a significant height of the swell and the wind sea state comprises a significant wind sea height, and wherein the monomodal excitation exhibits a total significant height equal to a root mean square of said significant height of the swell and of said significant wind sea height.

5. The method as claimed in claim 1, wherein the state of the swell comprises a peak period of the swell and the wind sea state comprises a peak wind sea period, and wherein the monomodal excitation exhibits a total peak period equal to one out of the peak period of the swell and the peak wind sea period selected as the period generating the most severe sloshing of the loading.

6. The method as claimed in claim 5, comprising a step for selecting the total peak period out of the peak period of the swell and the peak wind sea period by:

a first database consultation to determine a first sloshing generated by the peak period of the swell, a second database consultation to determine a second sloshing generated by the peak wind sea period, and a determination of the most severe sloshing out of the first sloshing and the second sloshing.

7. The method as claimed in claim 1, further comprising a step consisting in detecting that the vessel is subjected to a significantly multimodal excitation.

8. The method as claimed in claim 7, wherein a significantly multimodal excitation is detected when:

the significant height of the swell and of the significant wind sea height are non-zero, and the difference between the direction of the swell and of the wind sea direction is greater than 15°, and the significant height of the swell and the significant wind sea height are less than 85% of a root mean square of the significant height of the swell and of the significant wind sea height.

9. The method as claimed in claim 1, comprising a step of transmission of an audio or visual signal for an operator of the vessel when the datum relating to the sloshing is above a predetermined threshold.

10. A device (300) for determining the sloshing of a liquid loading of a vessel, said device comprising a processor (302) configured to implement the method (200) as claimed in claim 1.

11. A vessel (1) comprising a device (300) as claimed in claim 10.

* * * * *